United States Patent [19]

Habeeb et al.

[11] Patent Number: 4,826,612

[45] Date of Patent: May 2, 1989

[54] METHOD OF REDUCING THE WEAR OF METAL AND CERAMIC SURFACES

[75] Inventors: Jacob J. Habeeb, Westfield, N.J.; Alan G. Blahey; William N. Rogers, both of Clearwater, Canada

[73] Assignee: Exxon Research and Engineering Company, Florham Park, N.J.

[21] Appl. No.: 162,808

[22] Filed: Mar. 1, 1988

[51] Int. Cl.[4] ..... C10M 105/08

[52] U.S. Cl. ..... 252/32.7 E; 252/52 R; 252/48.2

[58] Field of Search ..... 252/32.7 E, 48.2, 52 R

[56] References Cited

PUBLICATIONS

Habeeb, et al., "The Role of Hydroperoxides in Engine Wear and the Effect of Zinc Dialkyldithiophosphate", ASLE Transaction, vol. 30, No. 4, May 11-14, 1987.

Habeeb et al., "The Role of Hydroperoxides in Engine Wear and the Effect of Zinc Dialkyldithiophosphate", ASLE Transactions, vol. 30, No. 4, pp. 419-426 (1987).

Habeeb et al., "The Role of Hydroperoxide in Engine Wear and the Effect of ZnDDP/Dispersant/Detergent Interactions", SAE Paper No. 872157 Presented at the International Fuels and Lubricants Meeting and Exposition in Toronto, Ontario, Canada (Nov. 2-5, 1987).

*Primary Examiner*—William R. Dixon, Jr.
*Assistant Examiner*—James M. Hunter, Jr.
*Attorney, Agent, or Firm*—John W. Ditsler

[57] ABSTRACT

The use of oxidants such as hydroperoxides in a lubricating oil have been found to be effective in reducing the war of one or more metal and/or ceramic surfaces in contact with an advanced ceramic surface. The reduced wear may be obtained in the absence of conventional antiwear additives such as zinc dialkyldithiophosphate.

40 Claims, 5 Drawing Sheets

LEGEND

- METAL, WITH ZDDP
- METAL, NO ZDDP
- $Si_3N_4$, WITH ZDDP
- $Si_3N_4$, NO ZDDP

LEGEND $Si_3N_4$, NO t-BHP $Si_3N_4$, WITH t-BHP

METHOD OF REDUCING THE WEAR OF METAL AND CERAMIC SURFACES

BACKGROUND OF THE INVENTION

1. Field of the Invention

The present invention relates to a method for reducing the wear of at least one metal and/or ceramic surface that is in contact with an advanced ceramic surface which comprises contacting said surfaces with a lubricating oil containing an oxidant such as hydroperoxide.

2. Description of Related Art

Wear is the primary factor that limits the life of an engine. Valve train represents one of the highest wear components within an engine, particularly for the newer models that have smaller but higher speed engines which incorporate current designs such as overhead camshafts, 4-valves per cylinder and turbochargers. In view of the trend toward extended drive train warranties, there is an increased demand for lubricants with improved antiwear performance. In a parallel effort, automotive engine and component manufacturers are enhancing valve train durability with emerging technologies such as roller followers and the use of advanced ceramic materials.

The use of advanced ceramics in high wear locations such as the valve train is attractive since they provide a potential for enhancing not only engine durability, but also performance. Among the ceramics used in engine applications are aluminum oxide ($Al_2O_3$), partially stabilized zirconium oxide (PSZ), silicon carbide (SiC), silicon nitride ($Si_3N_4$) and their hybrid combinations, all of which potentially offer a high degree of mechanical integrity, chemical inertness, thermal stability and hardness that would impart good wear resistance. Because of their low densities, ceramics can decrease inertial loads, which permits the use of valve springs with lower rates without causing valve float. This ultimately reduces the contact stresses at wear points.

Oxidants such as hydroperoxides are not normally added to engine lubricating oils because they facilitate degradation of the oil and promote engine wear (see Habeeb et al., "The Role of Hydroperoxides in Engine Wear and the Effect of Zinc Dialkyldithiophosphate," ASLE Transactions, Vol. 30, No. 4, pp. 419–26 (1987) and Habeeb et al., "The Role of Hydroperoxide in Engine Wear and the Effect of ZnDDP/Dispersant/Detergent Interactions," SAE Paper No. 872157 presented at the International Fuels and Lubricants Meeting and Exposition in Toronto, Ontario, Canada (Nov. 2–5, 1987), the disclosures of which are incorporated herein by reference). Therefore, it is surprising that reduced wear of a metal and/or ceramic surface in contact with an advanced ceramic surface can be obtained by contacting said surfaces with a lubricating oil containing an oxidant.

SUMMARY OF THE INVENTION

The present invention relates to a method for reducing the wear of at least one metal surface, one ceramic surface or mixtures thereof which is in contact with a ceramic surface. More specifically, reduced wear of at least one metal and/or ceramic surface in contact with a ceramic surface is obtained when said surfaces are contacted with one another in the presence of a lubricating oil containing small amounts of an oxidant. Preferred oxidants are hydroperoxides.

DETAILED DESCRIPTION OF THE INVENTION

Figure 1:
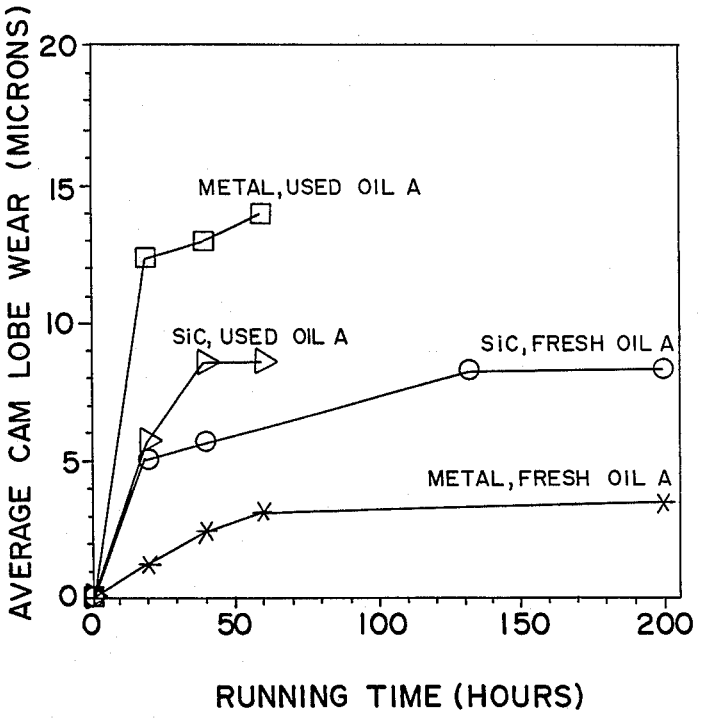
FIG. 1 is a plot of average cam lobe wear versus time which shows the effect of hydroperoxides on metal cam lobe wear in a 2.2 liter engine with metal and SiC follower pads.

According to the present invention, when a ceramic surface is contacted with at least one other surface in the presence of a lubricating oil, the wear of the other surface(s) is reduced or essentially eliminated if the lubricating oil contains an oxidant. While not wishing to be bound by any particular theory, it is believed that reduced wear of the other surface(s) is obtained due to an interaction of the oxidant with the ceramic surface which causes a change in the chemical structure of said ceramic surface. The resulting chemically modified ceramic surface is believed more resistant to wear than the unmodified surface. The reduced wear of the other surface(s) can be obtained in the absence of conventional antiwear additives such as ZDDP in the lubricating oil.

The ceramic surface which is used and modified in the present invention is derived from the so called "advanced ceramics" as that term is used in the art. "Advanced ceramics" include functional advanced ceramics (which include ceramics used in miniature hi-fidelity audio speakers, synthetic sapphire and a wide variety of computer chips) and structural advanced ceramics which have enhanced mechanical properties that make them desirable engineering materials. Structural advanced ceramics may be further subdivided into coatings or monolithics.

Using various procedures such as plasma spraying or sol gel technology, ceramic coatings may be applied to a metal surface to achieve a composite structure. The most widely used ceramic material for plasma-spraying is partially stabilized zirconia, which imparts high heat and chemical resistance.

Monolithic ceramics are materials from which entirely ceramic components may be fabricated. The leading simple monolithic ceramics are aluminum oxide ($Al_2O_3$), zirconium oxide ($ZrO_2$), silicon carbide (SiC) and silicon nitride ($Si_3N_4$). The material properties of the simple monolithics may be further enhanced by alloying the ceramics to form hybrid monolithics—mixing simple monolithics together to achieve a new material (e.g. Sialon is a mixture of $Al_2O_3$ and $Si_3N_4$)

toughened monolithics introducing a second phase into the parent material (e.g. whiskers, particles, filaments, etc.) or by causing a phase transformation (e.g.

the addition of oxides such as MgO, $Y_2O_3$ will toughen $ZrO_2$ to make partially stabilized zirconia)

ceramic/metal composites—the addition of metals and ceramics together has spawned new materials such as metal-matrix composites and ceramic-matrix composites.

Preferred advanced ceramics for use in the present invention are partially stabilized zirconia, $Al_2O_3$, SiC, $Si_3N_4$ or mixtures thereof, with SiC and $Si_3N_4$ or their mixtures being particularly preferred.

The other surface(s) (i.e., the surface(s) in contact with the ceramic surface) may be a metal surface or a ceramic surface, including an advanced ceramic surface as described above. If a metal surface, suitable metals include those normally found in the valve train of motorized vehicles; e.g. aluminum, iron, steel and the like. However, the present invention could be applied to essentially any metal or metal alloy that will wear when contacted with an advanced ceramic surface. Therefore, as used herein, "metal surface" refers to any metal or metal alloy which will wear when contacted with an advanced ceramic surface. Similarly, the present invention may be applied to essentially any ceramic or combination of ceramics that will wear when contacted with an advanced ceramic surface. As such, "ceramic surface" refers to any ceramic or combination of ceramics which will wear when contacted with an advanced ceramic surface.

The oxidant used herein can be essentially any oil soluble compound capable of chemically modifying the ceramic surface such that the surface is more wear resistant. Suitable oxidants include oxygen compounds such as peroxides (ROOR), hydroperoxides (ROOH), superoxides or mixtures thereof wherein R is a hydrocarbon radical containing from 1 to 18 (preferably from 2 to 12) carbon atoms, and includes alkyl, alkenyl, aryl, aralkyl, alkaryl and cycloaliphatic radicals. Preferably, R is an alkyl group of from 2 to 8 carbon atoms. Thus, the radicals may, for example, be ethyl, n-propyl, i-propyl, n-butyl, 1-butyl, sec-butyl, tert-butyl, amyl, n-hexyl, i-hexyl, n-heptyl, n-octyl, decyl, dodecyl, octadecyl, 2-ethylhexyl, phenyl butylphenyl, cyclohexyl, methylcyclopentyl, propenyl, butenyl, etc. In order to obtain oil solubility, the total number of carbon atoms in R will average about 4 or greater. Hydroperoxides are a preferred oxidant, with cumene hydroperoxide, t-butyl hydroperoxide or their mixtures being particularly preferred. Several of the oxidants mentioned above are commercially available. As such, their methods of manufacture are well known to those skilled in the art.

The amount of oxidant added to the lubricating oil will vary depending upon the amount of conventional antiwear additives present (if any), the specific operating parameters used and the specific application of the oil. In general, the amount need only be that which is effective to chemically modify the ceramic surface so as to cause a reduction in the wear of the metal or ceramic surface. Typically, however, the amount should range between about 0.01 and about 2.5 wt. % (preferably between about 0.1 and about 1.0 wt. %), although larger amounts could be used if desired.

The lubricating oil to which the oxidant is added will comprise a major amount of a lubricating basestock (or base oil). The basestock may include liquid hydrocarbons such as the mineral lubricating oils, synthetic lubricating oils or mixtures thereof. The mineral oils may include paraffinic, naphthenic as well as aromatic components. The synthetic oils may include diester oils such as di(2-ethylhexyl) sebacate, azelate and adipate; complex ester oils such as those formed from dicarboxylic acids, glycols and either monobasic acids or monohydric alcohols; polyolester oils such as esters or pentaerythritol and/or trimethylol propane; and other synthetic oils (including synthetic hydrocarbons) known to the art.

In addition to the oxidant, other additives known in the art may be added to the oil to form a partially or a fully formulated engine oil. Such additives include dispersants, other antiwear agents, antioxidants, corrosion inhibitors, detergents, pour point depressants, extreme pressure additives, viscosity index improvers and the like. These additives are typically disclosed, for example, in "Lubricant Additives" by C. V. Smalheer and R. Kennedy Smith, 1967, pp. 1–11 and in U.S. Pat. No. 4,105,571, the disclosures of which are incorporated herein by reference.

The contacting between the two or more surfaces will usually be a sliding or rubbing of the surfaces against one another. Although the contacting may be continuous or periodic, the benefits of the present invention will be most apparent when there is relative motion between the contacting surfaces. The contacting may occur over a broad range of conditions. For example, suitable temperatures and pressures will range from about 20° to about 150° C. and from about 80 to about 350 kPa, respectively. The contact time need be only that which is sufficient to effect a reduction in wear on the surface or surfaces in contact with the ceramic surface.

The present invention may be further understood by reference to the following examples which are not intended to restrict the scope of the claims appended hereto.

Experimental Procedure

In the following examples, valve train wear tests were performed using a 2.2 liter Chrysler engine and a Ford 2.3 liter engine from which the pistons and connecting rods had been removed. Both engines were driven with an 11.2 KW (15 horsepower) DC drive motor through a 1.2 timing belt drive. Although the 2.2 liter engine ran with standard valve springs (about 300 lbs/in), the 2.3 liter engine was equipped with stiffer valve springs (565 lbs/in) to increase the load between the cam lobes and the followers. Oil and coolant were circulated using engine mounted pumps. All test runs were made at an oil and coolant temperature of 90°±2° C. and an oil pressure of 330±8 kPa.

For each test, the engine was assembled with a new oil filter and metal camshaft. A new metal follower set was used for each test, but the ceramicized followers were reused in multiple tests since they were available in only limited numbers. Between tests, the ceramicized followers were carefully cleaned initially with a $C_6$ hydrocarbon solvent, followed by an acetone wash in an ultrasonic bath. The engine was initially flushed by being filled with a Solvent 150 neutral base oil and run at 1000 rpm for 15 minutes while heating the oil sump to about 50° C. The oil was then drained, a new filter installed, and the flushing procedure repeated to establish a process which helped break-in the new valve train components and reduce the effect of additive carryover between tests. The engine was filled with the test oil and heated to 90° C. before starting. Wear tests were performed at 1000±10 rpm, with periodic stopage for wear measurement.

Wear Measurement Procedures

Cam Lobe Wear—During operation, wear occurs on the lobes of the cam shaft and followers due to the sliding contact. Assessment of cam wear was made according to the Sequence V-D test described in ASTM Test No. STP 315H-Part 3, the disclosure of which is incorporated herein by reference. Wear is determined by measuring the cam lobe "heel-to-toe" dimension (cam base circle diameter plus maximum lift) at room temperature using a digital micrometer. The difference between the dimensions of the new and used cam lobes is a measure of the individual cam lobe wear, usually measured to an accuracy within about 2 microns. The individual lobe wear values from all eight lobes on the camshaft are averaged to provide a single value of average cam lobe wear. A typical test is run to 60 or to 80 hours, with measurements being taken at 20-hour intervals.

Follower Pad Wear—Metal and ceramic follower pad wear was measured using a Talysurf surface profilometer, a stylus device which is passed over the pad surface. The deflections of the stylus by the rough surface are amplified and recorded on an output profile. By making careful adjustments, the curvature of the pad surface can be eliminated from the output profile such that the profile shows only the extent of wear and the surface roughness. In this fashion, a direct measurement on the Talysurf output profile reflected a direct reading of the amount of wear.

Lubricating Oils

Two fully formulated commercially available engine lubricating oils were tested in both fresh and used conditions:

Oil A—a 10W-30 multigrade oil which exceeds the American Petroleum Institute's (API) SF/CD/EC classification.

Oil B—a 10W-30 multigrade oil which has an API SF/CC/EC classification.

Used oils were simulated by adding tert-butyl hydroperoxide (t-BHP) to the fresh oil (90 millimoles of hydroperoxide per 1000 g of oil which is equivalent to about 1.2 wt. % hydroperoxide).

EXAMPLE 1

Effect of Hydroperoxides on Metal Cam Lobe and Follower Wear in a 2.2 Liter Engine Using Oil A Valve train tests were performed in a Chrysler 2.2 liter engine operated with Oil A in fresh and used conditions. The average metal cam lobe wear obtained for metal and SiC follower pads is summarized in Table below and shown in FIG. 1:

TABLE 1

| | Average Metal Cam Lobe Wear, Microns | | | |
|---|---|---|---|---|
| | Fresh Oil A | | Used Oil A | |
| Time | Metal | SiC | Metal | SiC |
| 0 | 0 | 0 | 0 | 0 |
| 20 | 1.3 | 5.1 | 12 | 5.7 |
| 40 | 2.5 | 5.7 | 13 | 8.6 |
| 60 | 3.2 | — | 14 | 8.6 |
| 130 | — | 8.3 | — | — |
| 200 | 3.5 | 8.3 | — | — |

The data in Table 1 (and FIG. 1) show that:

For the metal follower pads, the addition of hydroperoxide (used Oil A) caused a significant increase in metal cam lobe wear relative to that obtained with fresh Oil A.

For ceramic follower pads, the addition of hydroperoxide did not cause additional steady-state metal cam lobe wear relative to the wear obtained with fresh Oil A.

For fresh Oil A, about twice as much wear was obtained with ceramic follower pads as with conventional metal follower pads.

After two valve train tests had been run on fresh Oil A, direct readings of metal and ceramic follower pad wear were made using a Talysurf surface profilometer. With metal followers, the Talysurf traces showed wear troughs of up to 20 microns at the wear zone edges and about 15 microns at the pad center. Alternatively, running the same test with the SiC followers resulted only in moderate pitting and no measurable deviation in the profile of the ceramic pad surface. Thus, the SiC followers have an improved wear resistance relative to conventional metallurgy.

EXAMPLE 2

Figure 2:
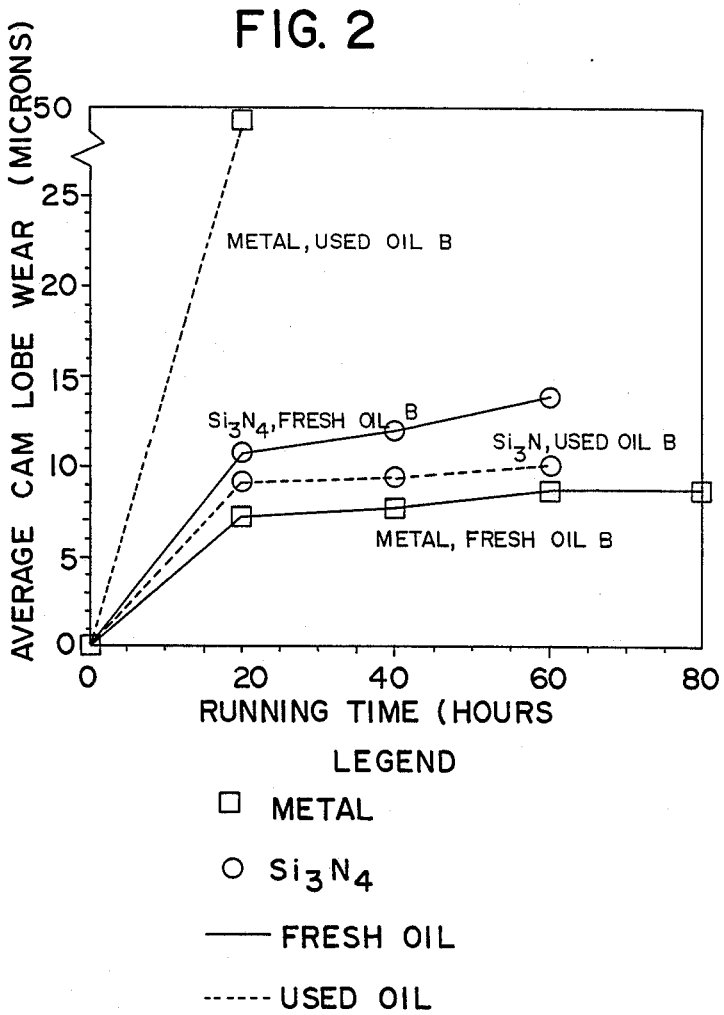
FIG. 2 is a plot of average cam lobe wear versus time which shows the effect of hydroperoxides on metal cam lobe wear in a 2.3 liter engine with metal and $Si_3N_4$ follower pads.

Effect of Hydroperoxides on Metal Cam Lobe and Follower Wear in a 2.3 Liter Engine Using Oil B Valve train tests were performed in a Ford 2.3 liter engine with Oil B in fresh and used conditions. $Si_3N_4$ ceramic followers were used. The results obtained are summarized in Table 2 below and shown in FIG. 2.

TABLE 2

| | Average Metal Cam Lobe Wear, Microns | | | |
|---|---|---|---|---|
| | Fresh Oil B | | Used Oil B | |
| Time | Metal | $Si_3N_4$ | Metal | $Si_3N_4$ |
| 0 | 0 | 0 | 0 | 0 |
| 20 | 7 | 10.8 | 48.6 | 9.2 |
| 40 | 8 | 12.1 | 115.3 | 9.5 |
| 60 | 9 | 14.0 | — | 10.2 |
| 80 | 9 | — | — | — |

The results in Table 2 confirm the conclusions made in Example 1 with respect to metal cam lobe wear, although significantly greater wear occurred for the metal followers. This was believed due to the inability of Oil B to protect against contaminants formed during oil oxidation and fuel combustion processes.

After four valve train tests had been run on used Oil B, significant follower pad wear had developed with the followers after 20 hours. Direct readings from the Talysurf traces showed wear troughs with depths of up to 120 microns at 20 hours, progressing to depths of up to 270 microns at 40 hours. The use of $Si_3N_4$ followers resulted in notably less wear. After 40 hours, Talysurf traces showed no noticeable deviation in surface form, but only a minor rounding of the asperities which resulted in a polished appearance. After 120 hours, only further polishing of the $Si_3N_4$ surface was observed, there being no measurable deviation in the pad surface form.

EXAMPLE 3

Effect of ZDDP on Metal Cam Lobe Wear in a 2.2 Liter Engine Using Oil A

Figure 3:
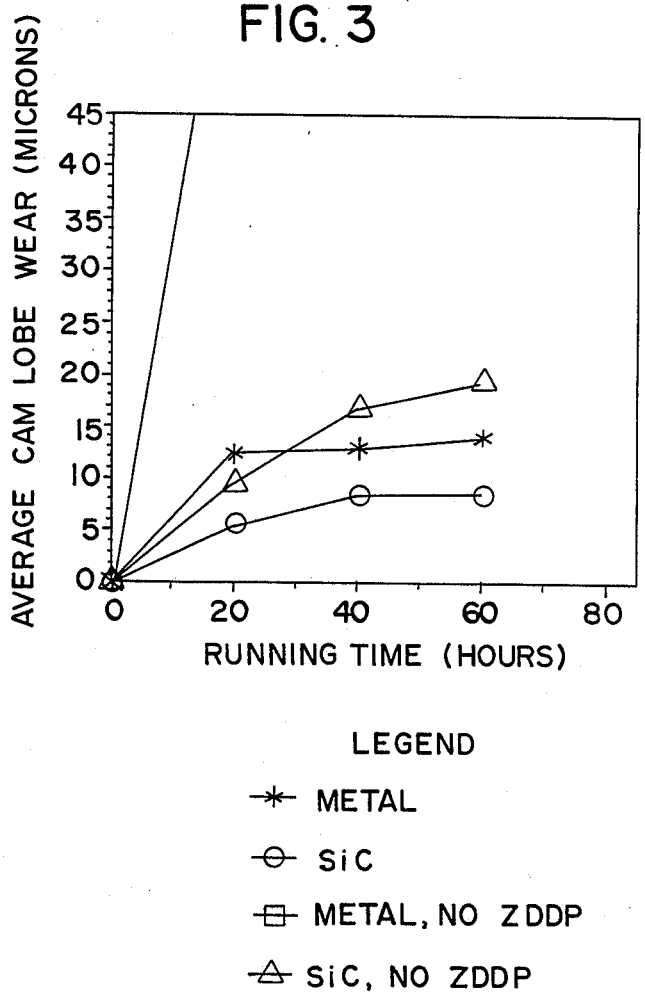
FIG. 3 is a plot of average cam lobe wear versus time which shows the effect of zinc dialkyldithiophosphate (ZDDP) on metal cam lobe wear in a 2.2 liter engine with metal and SiC follower pads.

The valve train tests of Example 1 were repeated on used Oil A with and without ZDDP. The results obtained are summarized in Table 3 below and shown in FIG. 3:

TABLE 3

| Time | Average Metal Cam Lobe Wear, Microns | | | |
|---|---|---|---|---|
| | With ZDDP | | Without ZDDP | |
| | Metal | SiC | Metal | SiC |
| 0 | 0 | 0 | 0 | 0 |
| 20 | 12.4 | 5.7 | >100 | 9.5 |
| 40 | 13.0 | 8.6 | — | 16.8 |
| 60 | 14.0 | 8.6 | — | 19.4 |

The data in Table 3 show that when ZDDP was removed from Oil A, the addition of hydroperoxide caused severe wear when metal followers were used; i.e. from 12 to over 110 microns in 20 hours. However, the wear increased from only about 5 to 8 microns over 60 hours when SiC followers were used.

EXAMPLE 4

Effect of ZDDP on Metal Cam Lobe Wear in a 2.3 Liter Engine Using Oil A

Figure 4:
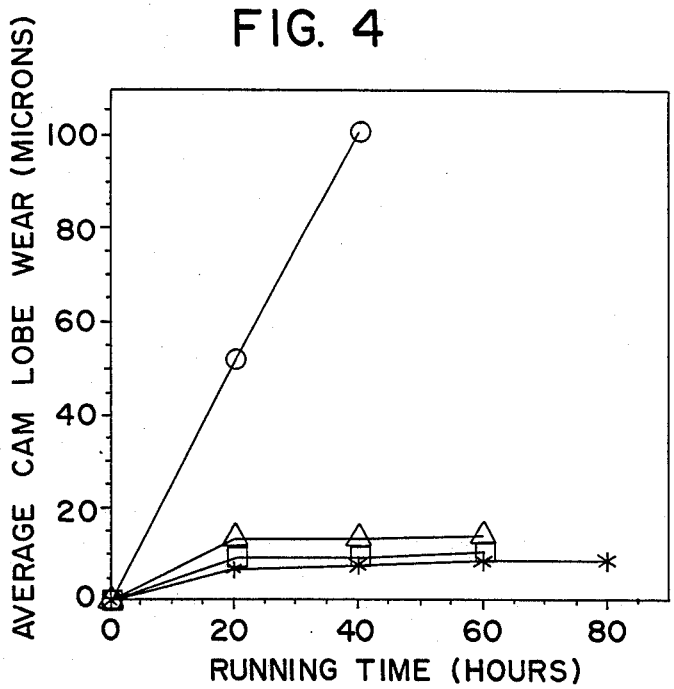
FIG. 4 is a plot of average cam lobe wear versus time which shows the effect of ZDDP on metal cam lobe wear in a 2.3 liter engine with metal and $Si_3N_4$ follower pads.

Valve train tests similar to Example 3 were performed in a Ford 2.3 liter engine using used Oil A with and without ZDDP. $Si_3N_4$ followers were used instead of SiC followers. The results are summarized in Table 4 below and shown in FIG. 4.

TABLE 4

| Time | Average Metal Cam Lobe Wear, Microns | | | |
|---|---|---|---|---|
| | With ZDDP | | Without ZDDP | |
| | Metal | $Si_3N_4$ | Metal | $Si_3N_4$ |
| 0 | 0 | 0 | 0 | 0 |
| 20 | 7.0 | 9.2 | 51.9 | 13.3 |
| 40 | 7.6 | 9.2 | 100.5 | 13.3 |
| 60 | 8.6 | 10.5 | — | 14.0 |
| 80 | 8.6 | — | — | — |

The data in Table 4 also show that severe metal cam lobe wear results when hydroperoxides are added to Oil A without ZDDP and that significantly less wear occurs when $Si_3N_4$ followers are used.

EXAMPLE 5

Figure 5:
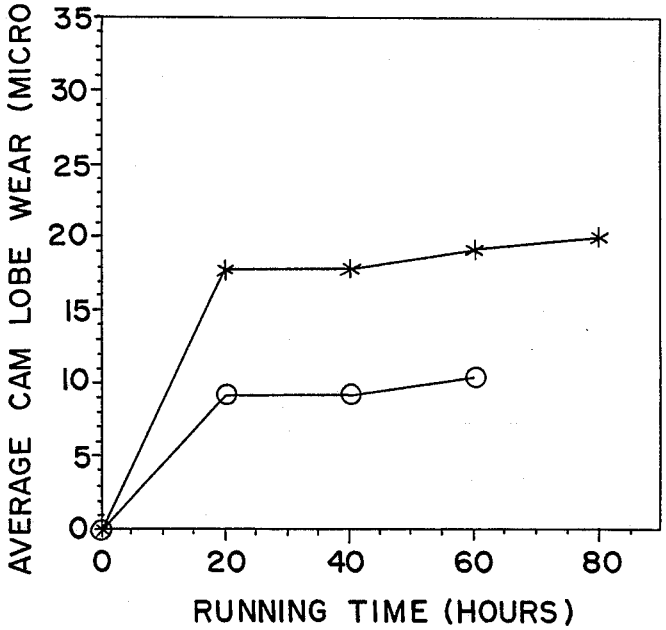
FIG. 5 is a plot of average cam lobe wear versus time which shows the effect of hydroperoxides on metal cam lobe wear in a 2.3 liter engine with $Si_3N_4$ follower pads.

Effect of Hydroperoxides on Metal Cam Lobe Wear in a 2.3 Liter Engine with $Si_3N_4$ Followers Using Oil A Valve train tests on a Ford 2.3 liter engine having $Si_3N_4$ padded followers were performed using fresh and used Oil A. The results obtained are summarized in Table 5 below and shown in FIG. 5.

TABLE 5

| Time | Average Metal Cam Lobe Wear, Microns | |
|---|---|---|
| | Fresh Oil A | Used Oil A |
| 0 | 0 | 0 |
| 20 | 17.8 | 9.2 |
| 40 | 17.8 | 9.2 |
| 60 | 19.1 | 10.5 |
| 80 | 20.0 | — |

The data in Table 5 show that the addition of a hydroperoxide significantly reduces the average metal cam lobe wear when ceramic followers are used.

What is claimed is:

1. A method for reducing the wear of at least one metal surface, at least one ceramic surface, or at least one metal and ceramic surface that is in contact with an advanced ceramic surface which comprises contacting the surfaces in the presence of a lubricating oil containing a lubricating basestock and an effective amount of an oxidant, said contacting occurring for a period of time sufficient to cause a reduction in the wear of said metal surface, said ceramic surface, or said metal and ceramic surface.

2. The method of claim 1 wherein the advanced ceramic surface is selected from the group consisting of aluminum oxide, partially stabilized zirconium oxide, silicon carbide, silicon nitride and mixtures thereof.

3. The method of claim 2 wherein said advanced ceramic surface is silicon carbide, silicon nitride or mixtures thereof.

4. The method of claim 2 wherein said metal surface, said ceramic surface, or said metal and ceramic surface is at least one ceramic surface.

5. The method of claim 2 wherein said metal surface, said ceramic surface, or said metal and ceramic surface is at least one metal surface.

6. The method of claim 1 wherein said oxidant is selected from the group consisting of peroxides, hydroperoxides, superoxides and mixtures thereof.

7. The method of claim 6 wherein said oxidant comprises a hydroperoxide.

8. The method of claim 1 wherein zinc dialkyldithiophosphate is present in said lubricating oil.

9. A method for reducing the wear of at least one metal surface that is in contact with an advanced ceramic surface which comprises contacting said surfaces in the presence of a lubricating oil containing from about 0.01 to about 2.5 wt. % of an oxidant for a period of time sufficient to cause a reduction in the wear of said metal surface.

10. The method of claim 9 wherein said advanced ceramic surface is selected from the group consisting of aluminum oxide, partially stabilized zirconium oxide, silicon carbide, silicon nitride and mixtures thereof.

11. The method of claim 10 wherein said advanced ceramic surface is silicon carbide, silicon nitride or mixtures thereof.

12. The method of claim 11 wherein said advanced ceramic surface comprises silicon carbide.

13. The method of claim 11 wherein said advanced ceramic surface comprises silicon nitride.

14. The method of claim 9 wherein said oxidant is selected from the group consisting of peroxides, hydroperoxides, superoxides and mixtures thereof.

15. The method of claim 14 wherein said oxidant comprises a hydroperoxides.

16. The method of claim 15 wherein said hydroperoxide is cumene hydroperoxide, tert-butyl hydroperoxide or mixtures thereof.

17. The method of claim 16 wherein said hydroperoxide comprises tert-butyl hydroperoxide.

18. The method of claim 9 wherein from about 0.1 to about 1.0 wt. % of said oxidant is present in said lubricating oil.

19. The method of claim 9 wherein zinc dialkyldithiophosphate is present in said lubricating oil.

20. A method for reducing the wear of a metal camshaft lobe due to contact with a follower in an internal combustion engine which comprises:

(a) using a follower having an advanced ceramic follower pad, and (b) contacting said camshaft lobe and said follower pad in the presence of a lubricating oil containing an oxidant in an amount sufficient to cause a reduction in the wear of said camshaft lobe.

21. A method for reducing the wear of an advanced ceramic camshaft lobe due to contact with a follower in an internal combustion engine which comprises:

(a) using a follower having a metal follower pad, and (b) contacting said camshaft lobe and said follower pad in the presence of a lubricating oil containing an oxidant in an amount sufficient to cause a reduction in the wear of said follower pad.

22. The method of claim 1 wherein the amount of oxidant ranges from about 0.01 to about 2.5 wt. %.

23. The method of claim 20 wherein the amount of oxidant ranges from about 0.01 to about 2.5 wt. %.

24. The method of claim 20 wherein said advanced ceramic is selected from the group consisting of aluminum oxide, partially stabilized zirconium oxide, silicon carbide, silicon nitride and mixtures thereof.

25. The method of claim 24 wherein said advanced ceramic surface is silicon carbide, silicon nitride or mixtures thereof.

26. The method of claim 24 wherein said oxidant is selected form the group consisting of peroxides, hydroperoxides, superoxides and mixtures thereof.

27. The method of claim 26 wherein said oxidant comprises a hydroperoxide.

28. The method of claim 27 wherein said hydroperoxide cumene hydroperoxide, tert-butyl hydroperoxide or mixtures thereof.

29. The method of claim 28 wherein said hydroperoxide comprises tert-butyl hydroperoxide.

30. The method of claim 20 wherein from about 0.1 to about 1.0 wt. % of said oxidant is present in said lubricating oil.

31. The method of claim 20 wherein zinc dialkyldithiophosphate is present in said lubricating oil.

32. The method of claim 21 wherein the amount of oxidant ranges from about 0.01 to about 2.5 wt. %.

33. The method of claim 21 wherein advanced ceramic is selected from the group consisting of aluminum oxide, partially stabilized zirconium oxide, silicon carbide, silicon nitride and mixtures thereof.

34. The method of claim 33 wherein said advanced ceramic surface is silicon carbide, silicon nitride or mixtures thereof.

35. The method of claim 33 wherein said oxidant is selected from the group consisting of peroxides, hydroperoxides, superoxides and mixtures thereof.

36. The method of claim 35 wherein said oxidant comprises a hydroperoxide.

37. The method of claim 36 wherein said hydroperoxide is cumene hydroperoxide, tert-butyl hydroperoxide or mixtures thereof.

38. The method of claim 37 wherein said hydroperoxide comprises tert-butyl hydroperoxide.

39. The method of claim 21 wherein from about 0.1 to about 1.0 wt. % of said oxidant is present in said lubricating oil.

40. The method of claim 21 wherein zinc dialkyldithiophosphate is present in said lubricating oil.

* * * * *